US010196911B2

(12) United States Patent
Jenkins et al.

(10) Patent No.: US 10,196,911 B2
(45) Date of Patent: Feb. 5, 2019

(54) ASSEMBLY FOR SEALING A GAP BETWEEN COMPONENTS OF A TURBINE ENGINE

(71) Applicant: United Technologies Corporation, Hartford, CT (US)

(72) Inventors: Decari S. Jenkins, Manchester, CT (US); Jorge I. Farah, Hartford, CT (US)

(73) Assignee: United Technologioes Corporation, Farmington, CT (US)

( * ) Notice: Subject to any disclaimer, the term of this patent is extended or adjusted under 35 U.S.C. 154(b) by 504 days.

(21) Appl. No.: 14/775,412

(22) PCT Filed: Mar. 14, 2014

(86) PCT No.: PCT/US2014/027075
§ 371 (c)(1),
(2) Date: Sep. 11, 2015

(87) PCT Pub. No.: WO2014/152209
PCT Pub. Date: Sep. 25, 2014

(65) Prior Publication Data

US 2016/0032746 A1 Feb. 4, 2016

Related U.S. Application Data

(60) Provisional application No. 61/783,404, filed on Mar. 14, 2013.

(51) Int. Cl.
*F01D 11/00* (2006.01)
*F01D 25/24* (2006.01)
(Continued)

(52) U.S. Cl.
CPC ..... *F01D 11/005* (2013.01); *F01D 9/041* (2013.01); *F01D 11/08* (2013.01); *F01D 25/246* (2013.01);
(Continued)

(58) Field of Classification Search
CPC ..... F05D 2240/58
See application file for complete search history.

(56) References Cited

U.S. PATENT DOCUMENTS 5,372,476 A 12/1994 Hemmelgarn et al.
5,411,369 A 5/1995 Bouchard
(Continued)

FOREIGN PATENT DOCUMENTS

EP 2098688 9/2009

OTHER PUBLICATIONS

EP search report for EP14770137 dated Dec. 8, 2015.

*Primary Examiner* — David E Sosnowski
*Assistant Examiner* — Juan G Flores
(74) *Attorney, Agent, or Firm* — O'Shea Getz P.C.

(57) ABSTRACT

A turbine engine assembly includes a first component, a second component and a third component arranged along an axis. The first component houses at least a portion of the third component. The assembly also includes a seal carrier, a seal land and a seal element, which seals a gap between the seal carrier and the seal land. The seal carrier is connected to the first component, and includes a groove surface and a groove. A first portion of the seal carrier seals a gap between a second portion of the seal carrier and the second component. The seal land is connected to the third component and includes a seal land surface. The seal element extends radially into the groove. The seal element is axially engaged with the groove surface and radially engaged with the seal land surface.

20 Claims, 8 Drawing Sheets

(51) Int. Cl.
*F01D 9/04* (2006.01)
*F01D 11/08* (2006.01)

(52) U.S. Cl.
CPC ..... *F05D 2220/30* (2013.01); *F05D 2240/12* (2013.01); *F05D 2240/58* (2013.01)

(56) References Cited

U.S. PATENT DOCUMENTS

| | | | | |
|---|---|---|---|---|
| 6,164,656 | A * | 12/2000 | Frost | F01D 11/005 277/312 |
| 2004/0120814 | A1 | 6/2004 | Branch et al. | |
| 2006/0245915 | A1 | 11/2006 | Tiemann | |
| 2012/0107122 | A1 | 5/2012 | Albers et al. | |
| 2012/0163964 | A1 | 6/2012 | Chuong et al. | |

* cited by examiner

ASSEMBLY FOR SEALING A GAP BETWEEN COMPONENTS OF A TURBINE ENGINE

CROSS-REFERENCE TO RELATED APPLICATIONS

This application claims priority to PCT Patent Appln. No. PCT/US14/27075 filed Mar. 14, 2014, which claims priority to U.S. Provisional Patent Appln. No. 61/783,404 filed Mar. 14, 2013, which are hereby incorporated herein by reference in their entireties.

BACKGROUND OF THE INVENTION

1. Technical Field

This disclosure relates generally to a turbine engine and, more particularly, to an assembly for sealing a gap between components of a turbine engine.

2. Background Information

Various types of seals are known in the art for sealing a gap between components of a turbine engine. A piston seal, for example, may seal a gap between a blade outer air seal (BOAS) and an outer platform of a guide vane arrangement. A typical piston seal, however, may permit leakage between the blade outer air seal and the outer platform during engine operation.

There is a need in the art for an improved seal for a turbine engine.

SUMMARY OF THE DISCLOSURE

According to an aspect of the invention, an assembly for a turbine engine is provided that includes a turbine engine first component, a turbine engine second component, a turbine engine third component, a seal carrier, a seal land and a seal element. The first, second and third components are arranged along an axis, and the first component houses at least a portion of the third component. The seal carrier is connected to the first component, and includes a groove surface and a groove. A first portion of the seal carrier at least partially seals a gap between a second portion of the seal carrier and the second component. The seal land is connected to the third component, and includes a seal land surface. The seal element extends radially into the groove, and at least partially seals a gap between the seal carrier and the seal land. The seal element is axially engaged with the groove surface and radially engaged with the seal land surface.

According to another aspect of the invention, an assembly for a turbine engine is provided that includes a case, a turbine engine component, a guide vane arrangement, a seal carrier, a seal land and a seal element. The case, the turbine engine component and the guide vane arrangement are arranged along an axis. The case houses at least a portion of the guide vane arrangement. The seal carrier is connected to the case, and includes a groove surface that at least partially defines a groove. A portion of the seal carrier sealingly engages the turbine engine component. The seal land is connected to the guide vane arrangement, and includes a seal land surface. The seal element extends radially into the groove, and at least partially seals a gap between the seal carrier and the seal land. The seal element is axially engaged with the groove surface and radially engaged with the seal land surface.

According to still another aspect of the invention, an assembly for a turbine engine is provided that includes a case, a turbine engine component, a guide vane arrangement, a seal carrier, a seal land, a first seal element and a second seal element. The case, the turbine engine component and the guide vane arrangement are arranged along an axis. The case houses at least a portion of the guide vane arrangement. The seal carrier is connected to the case, and includes a groove surface that at least partially defines a groove. The seal land is connected to the guide vane arrangement, and includes a seal land surface. The first seal element extends radially into the groove, and at least partially seals a gap between the seal carrier and the seal land. The seal element is axially engaged with the groove surface and radially engaged with the seal land surface. The second seal element is sealingly engaged between a portion of the seal carrier and the turbine engine component.

The first portion of the seal carrier may be located radially within and/or axially overlap the second component.

The first portion of the seal carrier may radially engage the second component.

The second component may include a first surface. The first portion of the seal carrier may extend radially outward to a second surface, which may axially overlap the first surface. A control gap may be defined radially between the first surface and the second surface.

The assembly may include a second seal element, which may be radially engaged between the second component and the first portion of the seal carrier.

The second seal element may be configured as or otherwise include an annular seal device.

The seal carrier may include one or more retainers, which may axially locate the second seal element relative to the portion of the seal carrier.

The seal carrier may include a base and a flange. The base may include the second portion of the seal carrier and the groove surface. The flange may extend axially from the base. The flange may also or alternatively include the first portion of the seal carrier.

The seal carrier may include a base that extends radially inwards from the first component to an inner side. The groove may extend radially into the base from the inner side.

The seal carrier may include a base and/or a cantilevered leg that connects to the base to the first component. The base and the cantilevered leg may define a channel. The base may define the groove. The channel may extend axially into the seal carrier to the cantilevered leg, and radially within the seal carrier between the base and the cantilevered leg.

The seal carrier may be attached to the first component. The seal carrier, for example, may be mechanically fastened to (e.g., press fit into) and/or bonded (e.g., welded, brazes and/or adhered) to the first component. Alternatively, the seal carrier may be formed integral with the first component.

The seal land may be attached to the third component. The seal land, for example, may be mechanically fastened to (e.g., press fit into) and/or bonded (e.g., welded, brazes and/or adhered) to the second component. Alternatively, the seal land may be formed integral with the third component.

The seal element may be configured as or otherwise include a piston seal.

The first component may be configured as or otherwise include a turbine engine case. The third component may be configured as or otherwise include a guide vane arrangement that includes an outer platform. The seal land may be connected to the outer platform.

The second component may be configured as or otherwise include a blade outer air seal.

The assembly may include a turbine engine case that is attached to the first component and houses at least a portion of the second component. A first plenum may extend radially between the first component and the third component. A second plenum may extend radially between the turbine engine case and the second component. The seal carrier may include one or more passages that direct air between the first plenum and the second plenum. In addition or alternatively, the first component may include one or more passages that direct air between the first plenum and the second plenum.

The foregoing features and the operation of the invention will become more apparent in light of the following description and the accompanying drawings.

DETAILED DESCRIPTION OF THE INVENTION

Figure 1:
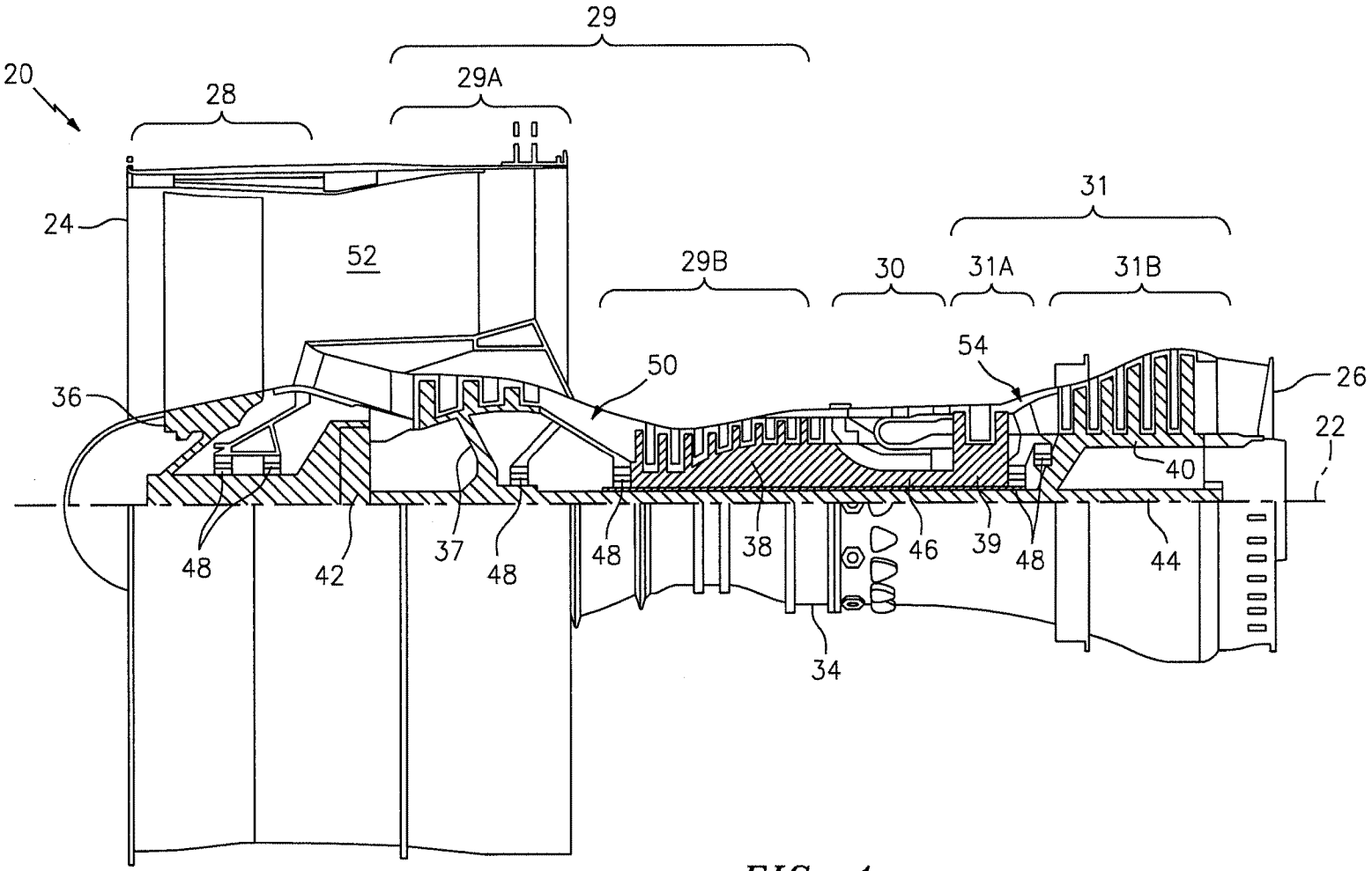
FIG. 1 is a side cutaway illustration of a geared turbine engine.

FIG. 1 is a side cutaway illustration of a geared turbine engine 20 that extends along an axis 22 between an upstream airflow inlet 24 and a downstream airflow exhaust 26. The engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34.

Each of the engine sections 28, 29A, 29B, 31A and 31B includes a respective rotor 36-40. Each of the rotors 36-40 includes a plurality of rotor blades arranged circumferentially around and connected to (e.g., formed integral with or attached to) one or more respective rotor disks. The fan rotor 36 is connected to a gear train 42; e.g., an epicyclic gear train. The gear train 42 and the LPC rotor 37 are connected to and driven by the LPT rotor 40 through a low speed shaft 44. The HPC rotor 38 is connected to and driven by the HPT rotor 39 through a high speed shaft 46. The low and high speed shafts 44 and 46 are rotatably supported by a plurality of bearings 48. Each of the bearings 48 is connected to the engine housing 34 by at least one stator such as, for example, an annular support strut.

Air enters the engine 20 through the airflow inlet 24, and is directed through the fan section 28 and into an annular core gas path 50 and an annular bypass gas path 52. The air within the core gas path 50 may be referred to as "core air". The air within the bypass gas path 52 may be referred to as "bypass air". The core air is directed through the engine sections 29-31 and exits the engine 20 through the airflow exhaust 26. Within the combustor section 30, fuel is injected into and mixed with the core air and ignited to provide forward engine thrust. The bypass air is directed through the bypass gas path 52 and out of the engine 20 to provide additional forward engine thrust, or reverse thrust via a thrust reverser.

Figure 2:
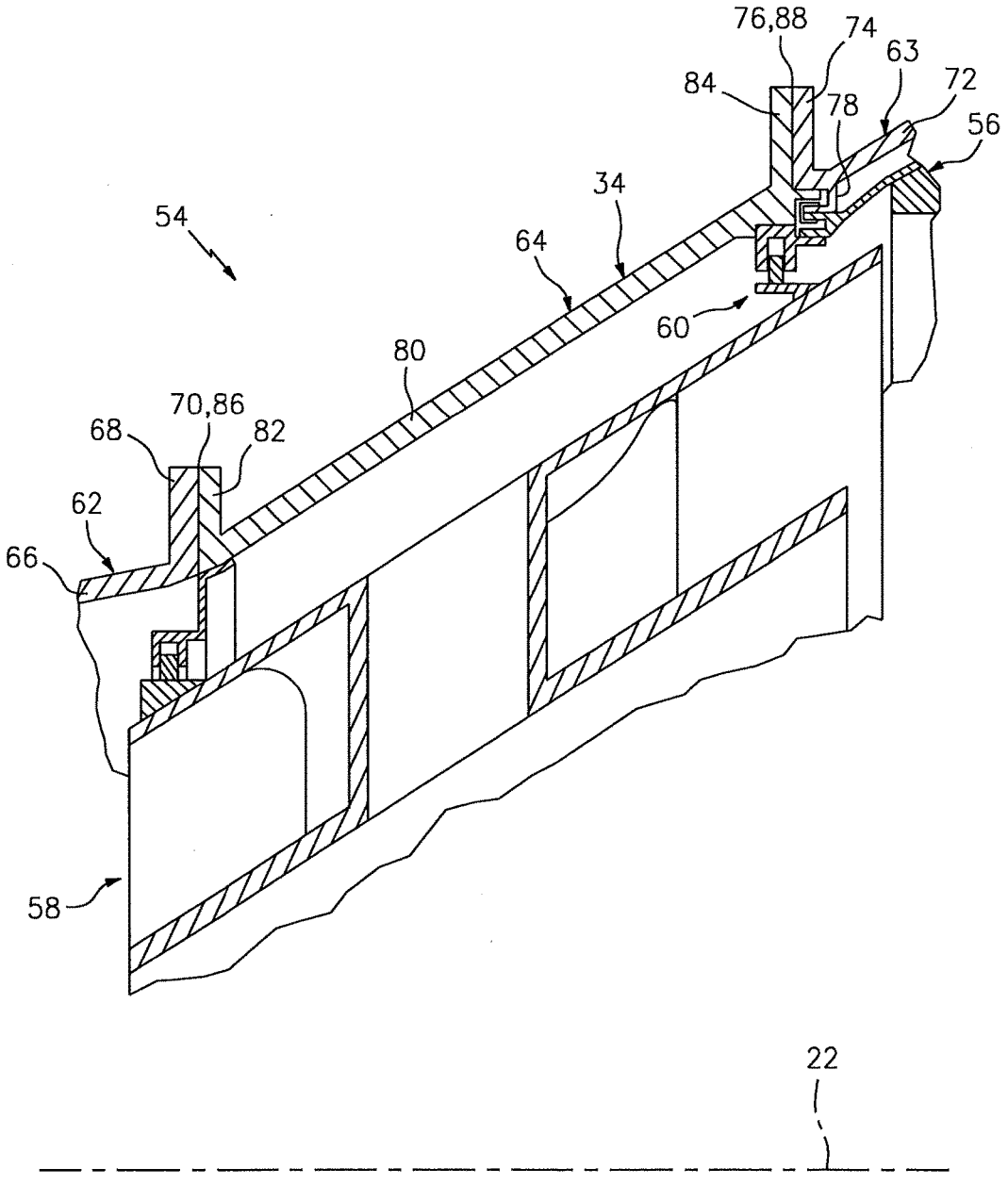
FIG. 2 is a side sectional illustration of a portion of an assembly for the turbine engine of FIG. 1.

FIG. 2 is a side sectional illustration of a portion of an assembly 54 for the engine 20 of FIG. 1. The assembly 54 includes at least a portion of the engine housing 34, a blade outer air seal 56 (BOAS), a stator guide vane arrangement 58 and a seal assembly 60.

The engine housing 34 includes a turbine engine upstream case 62, a turbine engine downstream case 63 and a turbine engine intermediate case 64. The upstream case 62 may be configured to house at least a portion of the HPT rotor 39 of FIG. 1. The upstream case 62 extends circumferentially around the axis 22. The upstream case 62 includes a tubular body 66 and a flange 68 (e.g., an annular flange). The body 66 extends along the axis 22 to a body downstream end 70. The flange 68 extends radially out from the body 66 at (e.g., on, adjacent or proximate) the downstream end 70.

The downstream case 63 may be configured to house at least a portion of the LPT rotor 40 of FIG. 1. The downstream case 63 extends circumferentially around the axis 22. The downstream case 63 includes a tubular body 72 and a flange 74 (e.g., an annular flange). The body 72 extends along the axis 22 to a body upstream end 76. The flange 74 extends radially out from the body 72 at the upstream end 76. The downstream case 63 may also include a mounting flange 78 (e.g., an annular flange).

The intermediate case 64 is configured to house at least a portion of the guide vane arrangement 58. The intermediate case 64 extends circumferentially around the axis 22. The intermediate case 64 includes a tubular body 80, an upstream flange 82 (e.g., an annular flange), and a downstream flange 84 (e.g., an annular flange). The body 80 extends along the axis 22 between a body upstream end 86 and a body downstream end 88. The upstream flange 82 extends radially out from the body 80 at the upstream end 86. The upstream flange 82 may be fastened to the flange 68 with one or more fasteners (not shown), which attaches the intermediate case 64 to the upstream case 62. The downstream flange 84 extends radially out from the body 80 at the downstream end 88. The downstream flange 84 may be fastened to the flange 74 with one or more fasteners (see FIG. 3), which attaches the intermediate case 64 to the downstream case 63.

Figure 3:
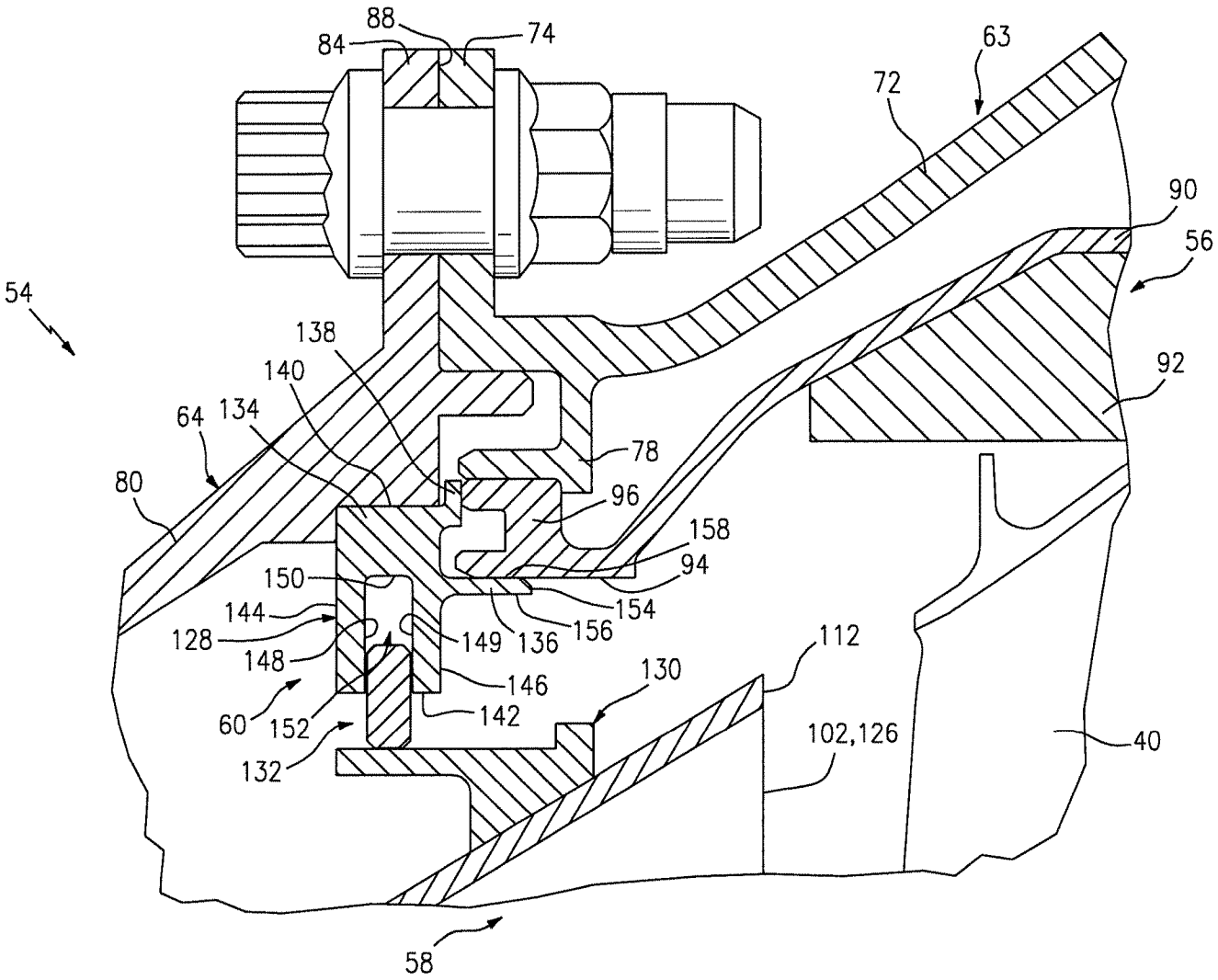
FIG. 3 is an enlarged side sectional illustration of a portion of the assembly of FIG. 2 at a first circumferential position.

Referring to FIG. 3, the blade outer air seal 56 extends circumferentially around the axis 22 (see FIG. 2). The blade outer air seal 56 may be configured from a plurality of circumferential BOAS segments, which are arranged circumferentially around the axis 22. Alternatively, the blade outer air seal 56 may be configured as a full hoop body. The blade outer air seal 56 includes a BOAS base 90 and an abradable seal element 92. The base 90 includes a BOAS surface 94 and a BOAS mount 96, which extends radially inwards to the surface 94. The mount 96 is attached to the mounting flange 78 with, for example, one or more clips 98 (see FIG. 6); e.g., C-clips. The abradable seal element 92 is arranged radially between the base 90 and the LPT rotor 40, and is attached (e.g., mechanically fastened and/or bonded) to the base 90.

Referring to FIGS. 1 and 2, the guide vane arrangement 58 is located radially within the intermediate case 64. The guide vane arrangement 58 may be configured to guide the flow of core gas between the HPT rotor 39 and the LPT rotor 40. Alternatively, the guide vane arrangement 58 may be configured to guide the flow of gas between or within any of the engine sections 28, 29A, 29B, 31A and 31B.

Figure 4:
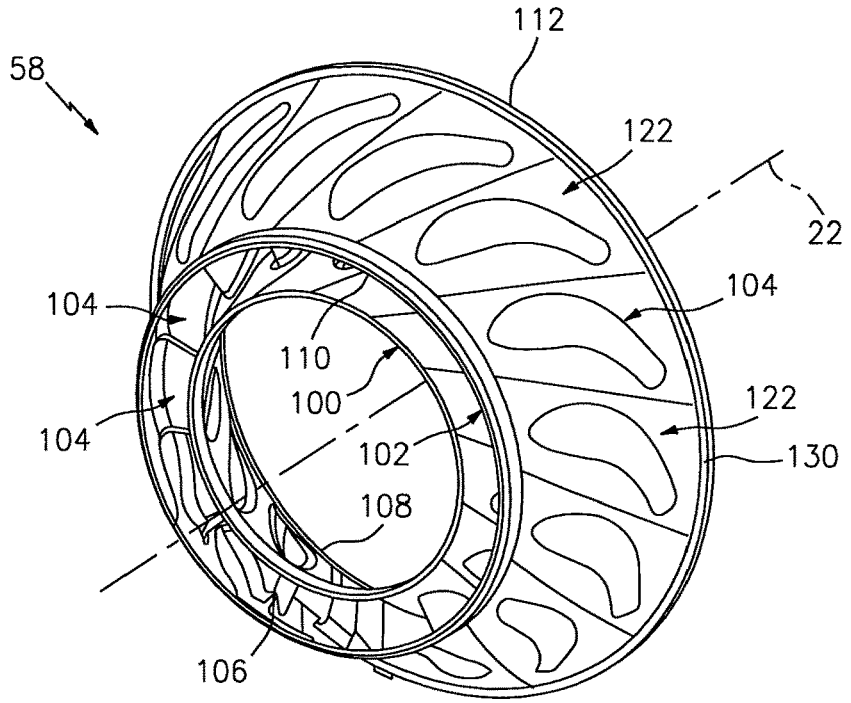
FIG. 4 is a perspective illustration of a guide vane arrangement for the assembly of FIG. 2.
Figure 5:
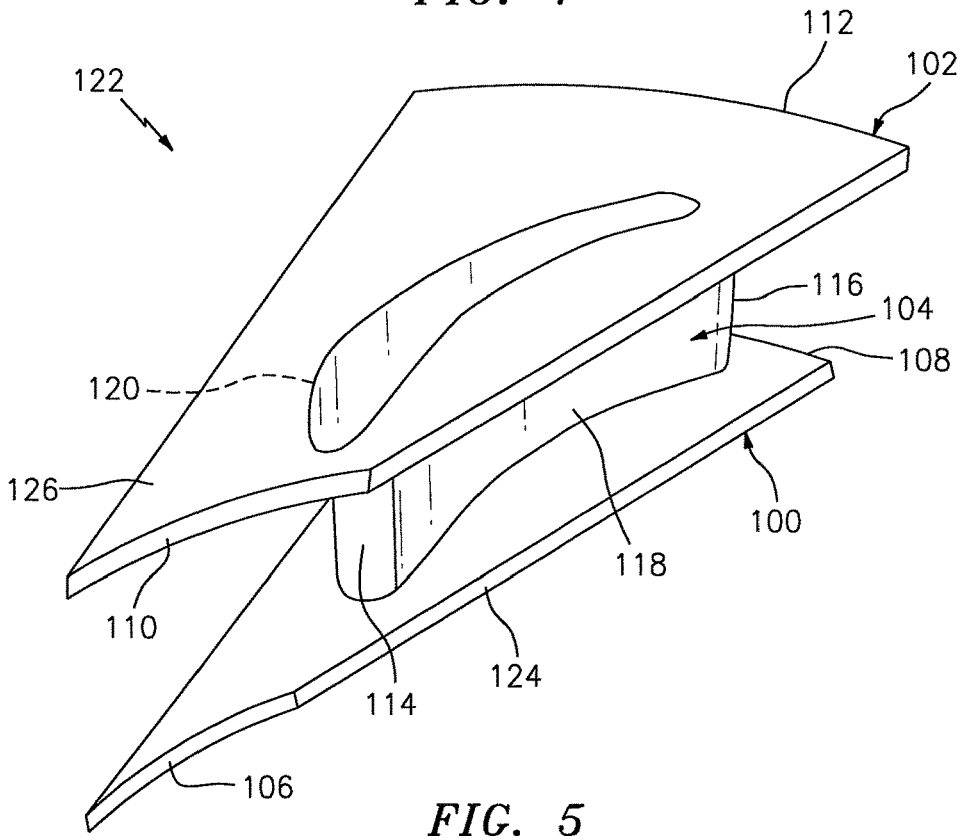
FIG. 5 is a perspective illustration of a vane arrangement segment for the guide vane arrangement of FIG. 4.

Referring to FIG. 4, the guide vane arrangement 58 includes a vane arrangement inner platform 100, a vane arrangement outer platform 102, and one or more stator guide vanes 104 (e.g., hollow guide vanes). The inner platform 100 and the outer platform 102 each extends circumferentially around the axis 22. The inner platform 100 extends axially between an inner platform upstream end 106 and an inner platform downstream end 108. The outer platform 102 extends axially between an outer platform upstream end 110 and an outer platform downstream end 112. The guide vanes 104 are arranged circumferentially around the axis 22. The guide vanes 104 extend radially between and are connected to the inner platform 100 and the outer platform 102. Referring to FIG. 5, one or more of the guide vanes 104 each extends axially between an upstream leading edge 114 and a downstream training edge 116. One or more of the guide vanes 104 each extends laterally (e.g., circumferentially or tangentially) between a concave surface 118 and a convex surface 120.

Referring to FIG. 4, the guide vane arrangement 58 may be configured from a plurality of vane arrangement segments 122. Referring to FIG. 5, one or more of the vane arrangement segments 122 each includes a (e.g., circumferential) segment 124 of the inner platform 100, a (e.g., circumferential) segment 126 of the outer platform 102, and at least one of the guide vanes 104. One or more of the vane arrangement segments 122 may each be configured as a unitary body. The guide vane 104, for example, may be cast, machined, milled and/or otherwise formed integral with the inner platform segment 124 and the outer platform segment 126. Alternatively, the inner platform 100 and/or the outer platform 102 may each be configured as a full hoop body, and the guide vanes 104 may be attached to the inner platform 100 and/or the outer platform 102.

Figure 3B:
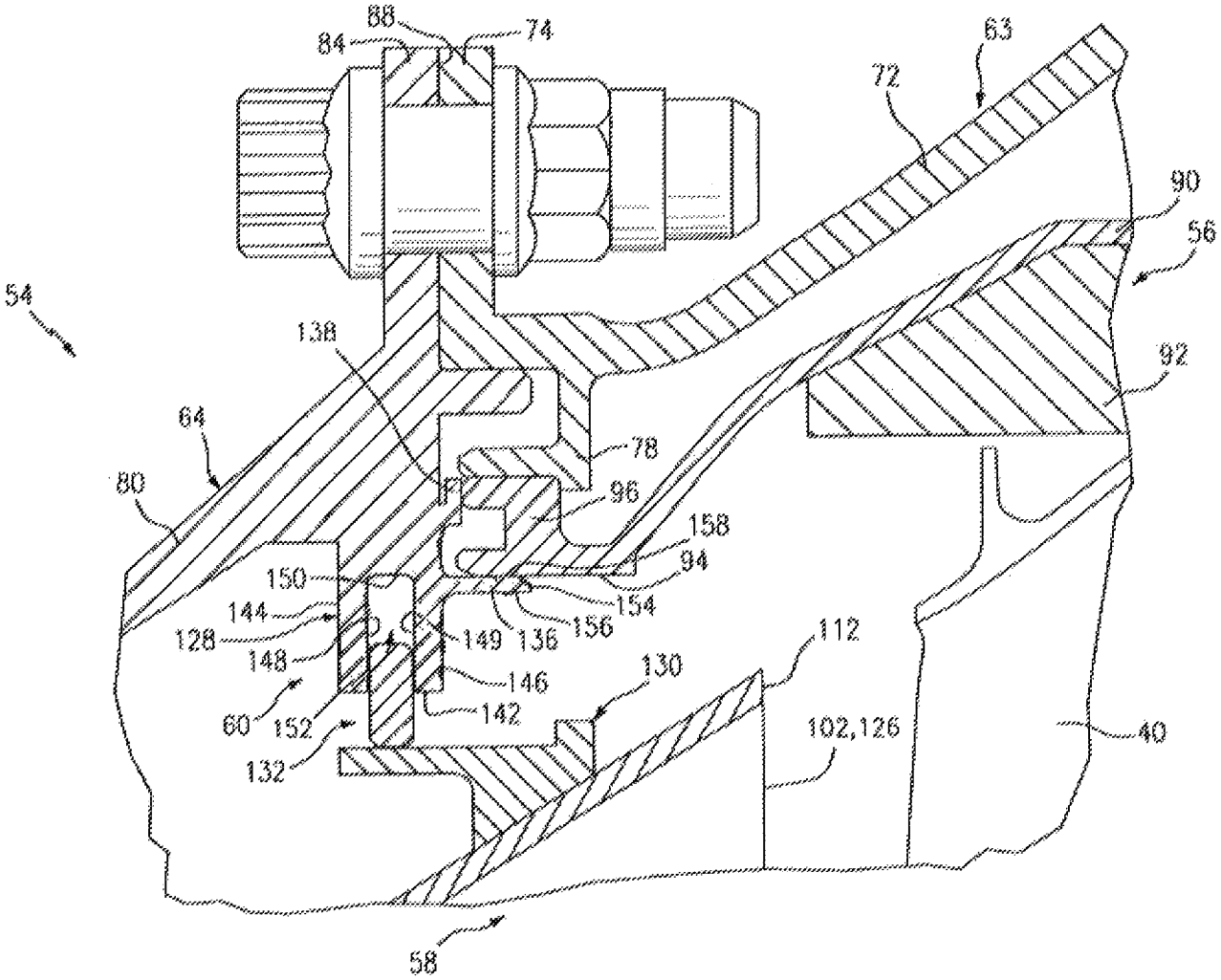
FIG. 3B is an enlarged side sectional illustration of a portion of the assembly of FIG. 2 configured with an alternate embodiment seal assembly.

Referring to FIG. 3, the seal assembly 60 includes a seal carrier 128 (e.g., a seal carrier ring), a seal land 130 (e.g., a seal land ring), and a seal element 132 (e.g., a seal ring). The seal carrier 128 is located radially within the body 80 at the downstream end 88. The seal carrier 128 may be mechanically fastened to (e.g., press fit into) and/or bonded (e.g., welded, brazed and/or adhered) to the body 80. Alternatively, the seal carrier 128 may be formed integral with the body 80 as shown in FIG. 3B. For example, the body 80, the upstream flange 82 (see FIG. 2), the downstream flange 84 and the seal carrier 128 may be cast, milled, machined and/or otherwise formed as a unitary body.

The seal carrier 128 includes a base 134, a flange 136 and one or more locating tabs 138. The base 134 extends circumferentially around the axis 22, and is connected to the body 80. The base 134 extends radially inwards from the body 80 and a base outer side 140 to a base inner side 142. The base 134 extends axially between a base upstream end 144 and a base downstream end 146. The base 134 includes one or more groove surfaces 148-150 that define a groove 152 (e.g., an annular channel or notch) in the seal carrier 128. The groove surfaces include an upstream side groove surface 148, a downstream side groove surface 149, and an end groove surface 150. The groove 152 extends radially into the base 134 from the base inner side 142 to the end groove surface 150. The groove 152 extends axially within the base 134 between the opposing side groove surfaces 148 and 149.

The flange 136 extends circumferentially around the axis 22. The flange 136 extends axially from the downstream end 146 to a downstream flange end 154. The flange 136 extends radially between a flange inner surface 156 and a flange outer surface 158 (e.g., an annular surface), which axially overlaps the BOAS surface 94. The outer surface 158 may radially and sealingly engage (e.g., contact) the BOAS surface 94. Alternatively, a control gap may be defined radially between the flange outer surface 158 and the BOAS surface 94. The term "control gap" may describe a gap that is sized to permit a relatively small degree of axial, radial and/or lateral movement between two elements (e.g., the flange 136 and the BOAS base 90), while reducing (e.g., minimizing) gas leakage between the elements. The control gap, for example, may have a radial height between about 0.000 inches and about 0.010 inches. In this manner, the flange 136 at least partially seals a gap between the base 134 and the blade outer air seal 56.

The locating tabs 138 are arranged circumferentially around the axis 22. The locating tabs 138 are connected to the base 134 at the base downstream end 146. The locating tabs 138 may axially engage the BOAS mount 96 to axially locate the blade outer air seal 56 within the engine 20.

Figure 6:
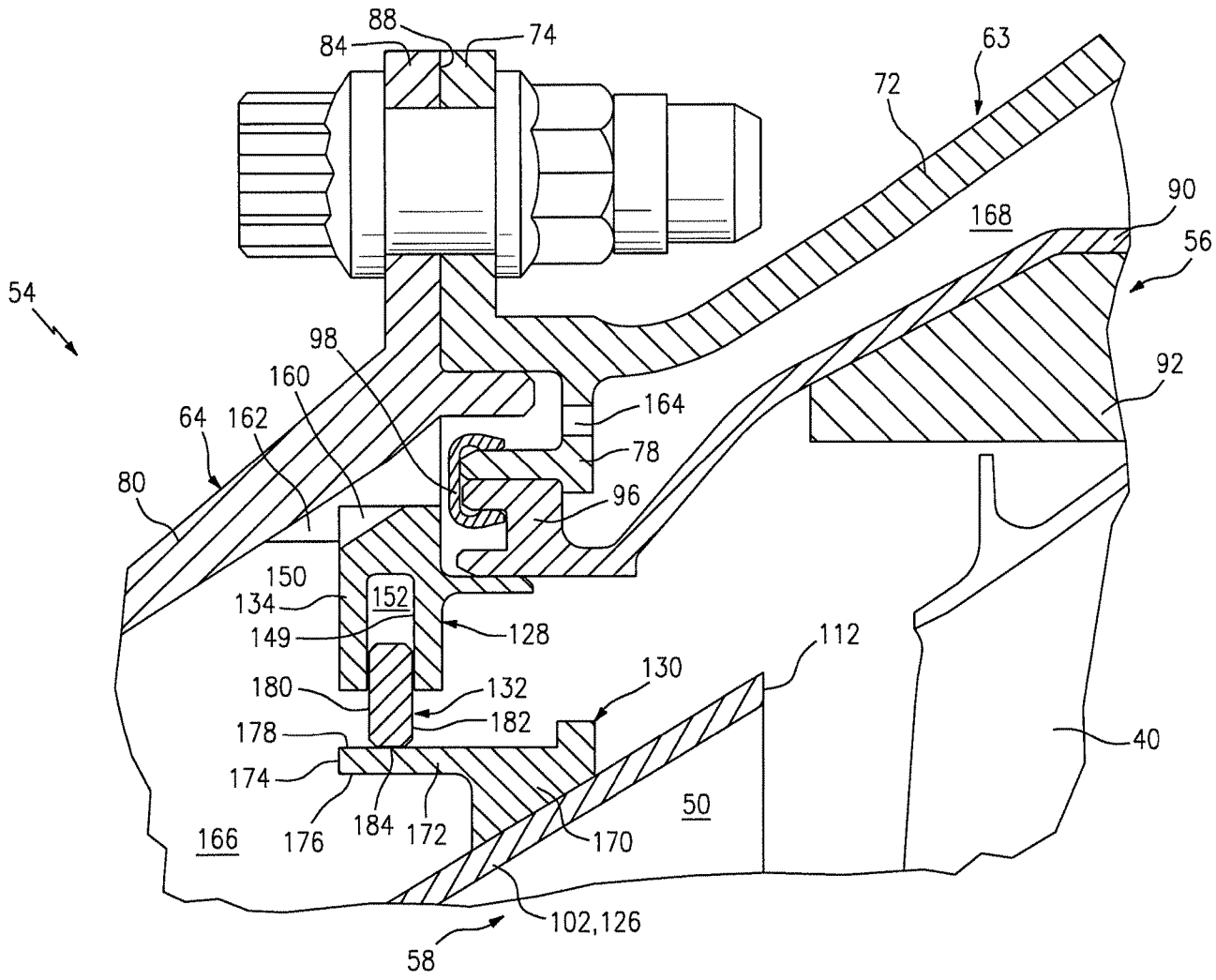
FIG. 6 is an enlarged side sectional illustration of a portion of the assembly of FIG. 2 at a second circumferential position.

Referring to FIG. 6, the seal carrier 128 also includes one or more cooling passages 160 (e.g., through-holes, channels, etc.) that are arranged circumferentially around the axis 22. The cooling passages 160 are fluidly coupled with one or more respective cooling passages 162 in the body 80 as well as with one or more respective cooling passages 164 in the mounting flange 78. In this manner, the cooling passages 160, 162 and 164 may direct cooling air (e.g., compressor bleed air) from a first plenum 166 to a second plenum 168 during turbine engine 20 operation. The first plenum 166 extends radially between the intermediate case 64 and the outer platform 102. The second plenum 168 extends radially between the downstream case 63 and the blade outer air seal 56.

The seal land 130 circumscribes the outer platform 102 at the outer platform downstream end 112. The seal land 130 may be mechanically fastened and/or bonded to the outer platform 102. Alternatively, the seal land 130 may include a plurality of (e.g., circumferential) segments, each of which is formed integral with a respective one of the outer platform segments 126.

The seal land 130 includes a base 170 and a flange 172 (e.g., an annular flange). The base 170 extends circumferentially around the axis 22, and is connected to the outer platform 102. The flange 172 extends circumferentially around the axis 22. The flange 172 extends axially from the base 170 to an upstream flange end 174. The flange 172 extends radially from a flange inner surface 176 to a seal land outer surface 178.

The seal element 132 may be configured as a piston seal with a full hoop body, or a split ring body. The seal element 132, for example, extends circumferentially around the axis 22. The seal element 132 extends axially between a seal element upstream surface 180 and a seal element downstream surface 182. The seal element 132 extends radially between a seal element inner surface 184 and a seal element outer surface 186. The present invention, however, is not limited to any particular seal element types or configurations.

The seal element 132 at least partially seals a gap between the seal carrier 128 and the seal land 130. The seal element 132, for example, extends radially into the groove 152. The seal element 132 axially and sealingly engages the downstream side groove surface 149. The seal element 132 radially and sealingly engages the seal land outer surface 178.

During turbine engine 20 operation, the outer platform 102 may be subject to relatively high temperatures, whereas the intermediate case 64 may be subject to relatively low temperatures. This temperature differential may cause disproportional thermal growth between the outer platform 102 and the intermediate case 64, which may cause the seal land 130 to move axially and/or radially relative to the seal carrier 128. The seal element 132, however, may at least partially accommodate such movement by sliding radially against the downstream side groove surface 149 and/or sliding axially against the seal land outer surface 178.

The seal carrier 128 may also be subject to a different temperature and/or thermal growth rate than the intermediate case 64. However, by attaching (e.g., press fitting) the seal carrier 128 to the intermediate case 64, the seal carrier 128 may grow relative to the intermediate case 64 without causing significant internal stresses in the seal carrier 128 and/or the intermediate case 64. Similarly, by having a low profile (e.g., radial height), the seal land 130 mitigates thermal induced stress and distortions. In addition, by attaching (e.g., bonding) the seal land 130 to the outer platform 102, the seal land 130 may grow relative to the outer platform 102 without causing significant internal stresses in the seal land 130 and/or the outer platform 102.

In addition to the foregoing, the cooling air between the flange 172 and the outer platform 102 may reduce the temperature of the flange 172, which may in turn reduce the temperature of the seal element 132. The assembly 54 therefore may utilize a seal element with a relatively low maximum operating temperature, which may enable the seal element 132 to be manufactured with relatively inexpensive materials and/or relatively inexpensive manufacturing techniques (e.g., formed from wire or bar stock rather than milling from a forging or casting).

Figure 7:
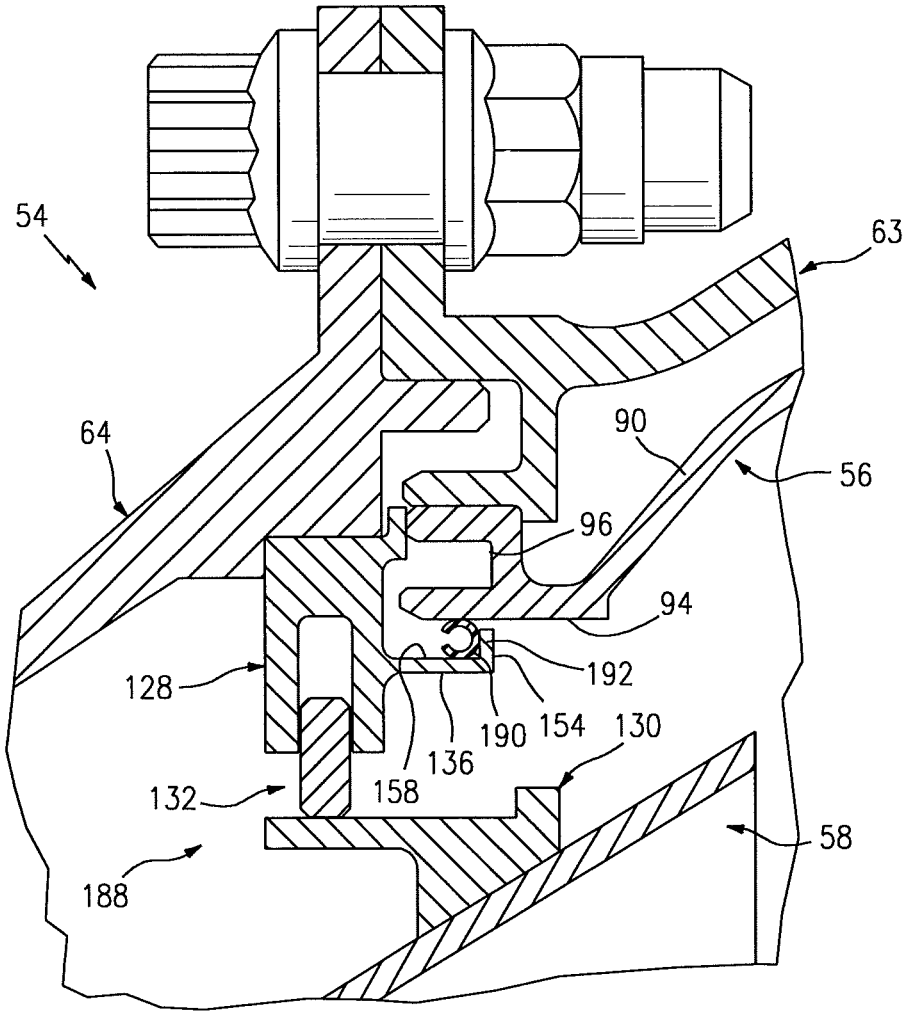
FIG. 7 is an enlarged side sectional illustration of a portion of the assembly of FIG. 2 configured with an alternate embodiment seal assembly.

FIG. 7 illustrates the assembly 54 with an alternate embodiment seal assembly 188. In contrast to the seal assembly 60 of FIG. 3, the seal assembly 188 further includes a second seal element 190 that at least partially seals the gap between the flange 136 and the BOAS base 90. The second seal element 190 may also permit slight radial movement between the flange 136 and the BOAS base 90. The second seal element 190, for example, is sealing engaged between the flange outer surface 158 and the BOAS surface 94. The second seal element 190 may be configured as a flexible annular seal device such as, for example, a C-seal, a V-seal, a W-seal, an E-seal, etc. The second seal element 190 may be axially located relative to the flange 136 and/or the BOAS base 90 with one or more retainers 192 (e.g., tabs or a rim). The retainers 192 are arranged circumferentially around the axis 22, and extend radially out from the flange 136 at the downstream flange end 154.

Figure 8:
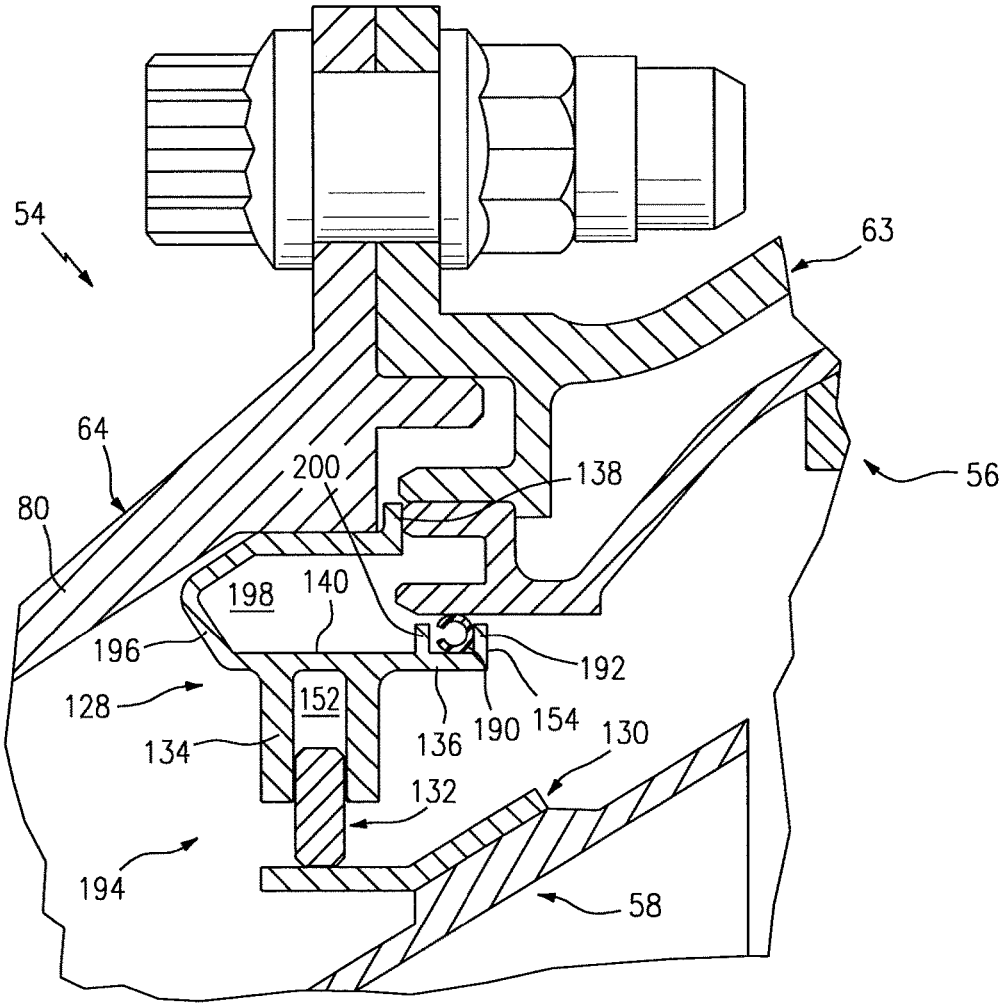
FIG. 8 is an enlarged side sectional illustration of a portion of the assembly of FIG. 2 configured with another alternate embodiment seal assembly.

FIG. 8 illustrates the assembly 54 with another alternative embodiment seal assembly 194. In contrast to the seal assembly 188 of FIG. 7, the seal carrier 128 of the seal assembly 194 includes a cantilevered leg 196 and a channel 198 (e.g., an annular channel). The cantilevered leg 196 is attached to the intermediate case 64, and connects the base 134 to the body 80. The cantilevered leg 196 extends circumferentially around the axis 22. The cantilevered leg 196 defines the channel 198 with the base 134. The channel 198, for example, extends axially (e.g., in an upstream direction) into the seal carrier 128 to the cantilevered leg 196. The channel 198 extends radially within the seal carrier 128 between the cantilevered leg 196 and the base outer side 140. The seal carrier 128 may also include one or more additional retainers 200 (e.g., tabs or a rim) that form a channel with the retainers 192 in which the second seal element 190 is arranged.

The cantilevered leg 196 may increase a length of a thermal path between the base 134 and the intermediate case 64, which may reduce the temperature differential between the base 134 and the seal land 130. The cantilevered leg 196 therefore may reduce thermally induced movement between the base 134 and the seal land 130. In addition, the cantilevered leg 196 may also permit slight radial movement between the base 134 and the intermediate case 64.

One or more components of the assembly 54 may have various configurations other than those described above. One or more of the components 56, 58 and 62-64, for example, may each be configured as a duct, an annular strut, an adjustable guide vane arrangement or any other type of turbine engine component. A portion of the base 134 or any other part of the seal carrier 128 may define the outer surface 158. One or more of the seal elements 132 and 190 may each be configured from a plurality of segments, which are arranged circumferentially around the axis 22. The present invention therefore is not limited to any particular assembly components types and/or configurations.

The terms "upstream", "downstream", "inner" and "outer" are used to orientate the components of the assembly 54 described above relative to the turbine engine 20 and its axis 22. A person of skill in the art will recognize, however, one or more of these components may be utilized in other orientations than those described above. For example, the seal assembly may be arranged at the upstream end of the guide vane arrangement 58, located within the inner platform 100, etc. The present invention therefore is not limited to any particular assembly spatial orientations.

The assembly 54 may be included in various turbine engine sections and/or turbine engines other than that described above. The assembly, for example, may be included in a geared turbine engine where a gear train connects one or more shafts to one or more rotors in a fan section, a compressor section and/or any other engine section. Alternatively, the assembly may be included in a turbine engine configured without a gear train. The assembly may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, comprising:

a turbine engine first component, a turbine engine second component and a turbine engine third component arranged along an axis, the first component housing at least a portion of the third component;

a seal carrier connected to the first component and including a groove surface and a groove, wherein a first portion of the seal carrier at least partially seals a gap between a second portion of the seal carrier and the second component;

a seal land connected to the third component and including a seal land surface; and a seal element extending radially into the groove and at least partially sealing a gap between the seal carrier and the seal land, wherein the seal element is axially engaged with the groove surface and radially engaged with the seal land surface;

wherein the seal element comprises a piston seal.

2. The assembly of claim 1, wherein the first portion of the seal carrier is located radially within and axially overlaps the second component.

3. The assembly of claim 2, wherein the first portion of the seal carrier radially engages the second component.

4. The assembly of claim 2, wherein the second component includes a first surface;

the first portion of the seal carrier extends radially outward to a second surface that axially overlaps the first surface; and a control gap is defined radially between the first surface and the second surface.

5. The assembly of claim 2, further comprising a second seal element radially engaged between the second component and the first portion of the seal carrier.

6. The assembly of claim 5, wherein the second seal element comprises an annular seal device.

7. The assembly of claim 5, wherein the seal carrier includes one or more retainers that axially locate the second seal element relative to the portion of the seal carrier.

8. The assembly of claim 2, wherein the seal carrier includes a base and a flange;

the base includes the second portion of the seal carrier and the groove surface; and the flange extends axially from the base, and includes the first portion of the seal carrier.

9. The assembly of claim 1, wherein the seal carrier includes a base that extends radially inwards from the first component to an inner side, and the groove extends radially into the base from the inner side.

10. The assembly of claim 1, wherein the seal carrier includes a base and a cantilevered leg that connects to the base to the first component;

the base and the cantilevered leg define a channel, and the base defines the groove; and the channel extends axially into the seal carrier to the cantilevered leg, and radially within the seal carrier between the base and the cantilevered leg.

11. The assembly of claim 1, wherein the seal carrier is attached to the first component.

12. The assembly of claim 1, wherein the seal carrier is formed integral with the first component.

13. The assembly of claim 1, wherein the first component comprises a turbine engine case;

the third component comprises a guide vane arrangement that includes an outer platform; and the seal land is connected to the outer platform.

14. The assembly of claim 13, wherein the second component comprises a blade outer air seal.

15. The assembly of claim 1, further comprising:

a turbine engine case attached to the first component and housing at least a portion of the second component;

wherein a first plenum extends radially between the first component and the third component, and a second plenum extends radially between the turbine engine case and the second component; and wherein the seal carrier includes one or more passages that direct air between the first plenum and the second plenum.

16. The assembly of claim 1, further comprising:

a turbine engine case attached to the first component and housing at least a portion of the second component;

wherein a first plenum extends radially between the first component and the third component, and a second plenum extends radially between the turbine engine case and the second component; and wherein the first component includes one or more passages that direct air between the first plenum and the second plenum.

17. The assembly of claim 1, wherein the groove surface is configured perpendicular to the axis.

18. The assembly of claim 1, wherein the seal element comprises a surface that is perpendicular to the axis.

19. An assembly for a turbine engine, comprising:

a case, a turbine engine component and a guide vane arrangement arranged along an axis, the case housing at least a portion of the guide vane arrangement;

a seal carrier connected to the case and including a first side groove surface and a second side groove surface that at least partially define a groove, wherein a portion of the seal carrier sealingly engages the turbine engine component, and the first and second groove surfaces are each perpendicular to the axis;

a seal land connected to the guide vane arrangement and including a seal land surface; and a seal element extending radially into the groove and at least partially sealing a gap between the seal carrier and the seal land, wherein the seal element is axially engaged with the first side groove surface and radially engaged with the seal land surface.

20. The assembly of claim 19, wherein the seal element is configured as a piston seal.

* * * * *